United States Patent [19]

Elson

[11] 4,427,349

[45] Jan. 24, 1984

[54] REFRIGERATION COMPRESSOR SUSPENSION SYSTEM

[75] Inventor: John P. Elson, Sidney, Ohio

[73] Assignee: Copeland Corporation, Sidney, Ohio

[21] Appl. No.: 298,265

[22] Filed: Aug. 31, 1981

Related U.S. Application Data

[60] Continuation of Ser. No. 61,287, Jul. 27, 1979, abandoned, which is a division of Ser. No. 767,385, Feb. 10, 1977, Pat. No. 4,174,189.

[51] Int. Cl.[3] ..... F04B 35/04

[52] U.S. Cl. ..... 417/363

[58] Field of Search ..... 417/363

[56] References Cited

U.S. PATENT DOCUMENTS

| | | |
|---|---|---|
| 2,857,746 | 10/1958 | Philipp . |
| 2,894,678 | 7/1959 | Hintze . |
| 3,016,183 | 1/1962 | Murphy et al. . |
| 3,044,688 | 7/1962 | Frank et al. . |
| 3,169,696 | 2/1965 | Warner . |
| 3,182,902 | 5/1965 | Foris . |
| 3,185,389 | 5/1965 | Loberg . |
| 3,209,991 | 10/1965 | Sauber . |
| 3,215,343 | 11/1965 | Gannaway . |
| 3,233,822 | 2/1966 | Comstock et al. . |
| 3,246,836 | 4/1966 | Ayling . |
| 3,279,683 | 10/1966 | Kleinlein . |
| 3,385,542 | 5/1968 | Enemark et al. . |
| 3,454,213 | 7/1969 | Valbjorn . |
| 3,458,121 | 7/1969 | Gleason, Jr. et al. . |
| 3,689,207 | 9/1972 | Abell et al. . |
| 3,807,907 | 4/1974 | Gannaway . |
| 3,836,290 | 9/1974 | Carter . |
| 3,850,551 | 11/1974 | Gamache et al. . |
| 3,876,339 | 4/1975 | Gannaway . |
| 3,883,101 | 5/1975 | Vernier . |
| 4,118,153 | 10/1978 | Stannow et al. . |

FOREIGN PATENT DOCUMENTS

| | | | |
|---|---|---|---|
| 1266358 | 9/1959 | Fed. Rep. of Germany | 417/363 |
| 1266358 | 5/1961 | France . | |
| 923759 | 4/1963 | United Kingdom . | |

*Primary Examiner*—William L. Freeh

*Attorney, Agent, or Firm*—Harness, Dickey & Pierce

[57] ABSTRACT

There is disclosed herein a suspension system including a shipping stop arrangement for resiliently mounting a refrigeration motor-compressor unit within a hermetically sealed shell. The suspension system comprises a three point supporting arrangement employing a pair of laterally disposed springs, each having a single tapered portion, for providing vertical support to the motor-compressor, in combination with a single top spring for providing lateral stability. Lateral and vertical motion limiting shipping stops are also provided to prevent excessive movement of the motor-compressor, such as may occur during shipment thereof, from damaging the suspension system members. In addition, the system is capable of accommodating different size motor-compressor units in a standardized hermetic shell size by using simple spacers of different sizes.

9 Claims, 6 Drawing Figures

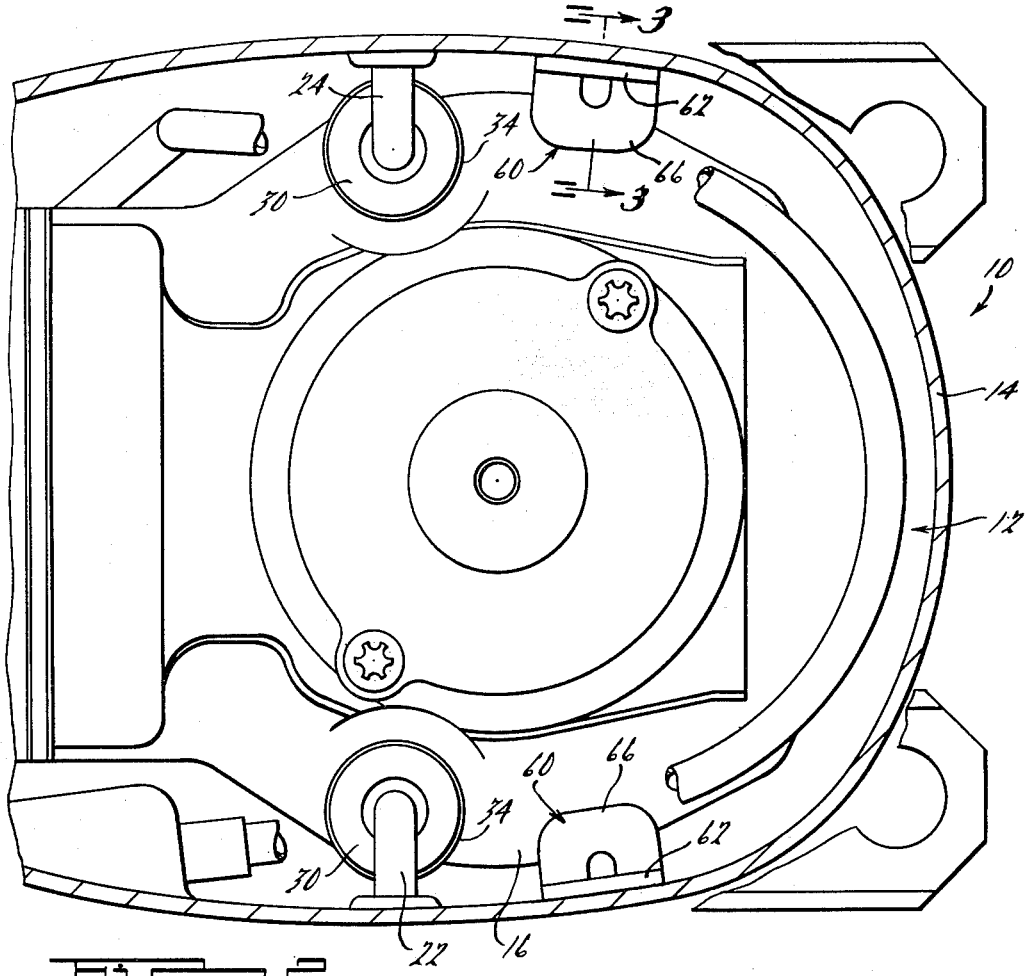
FIG. 2.
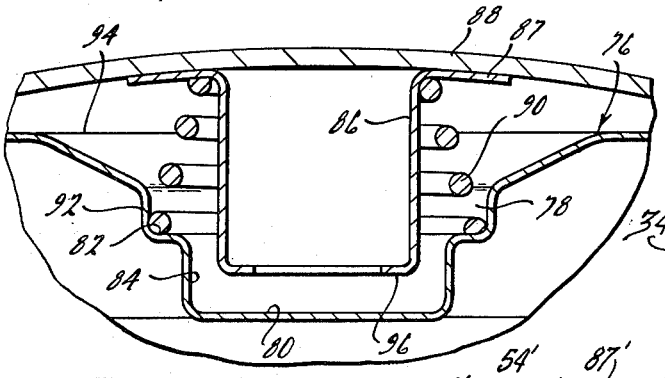
FIG. 5.
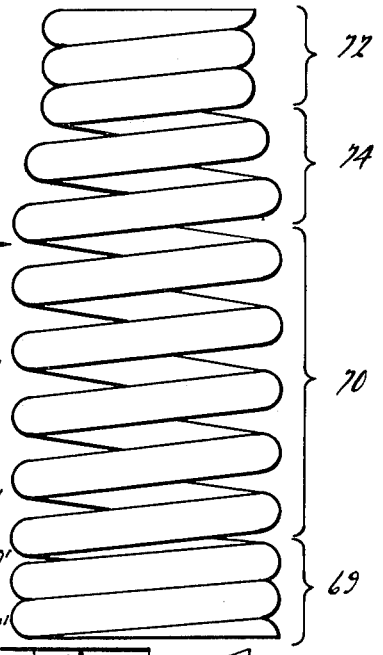
FIG. 4.
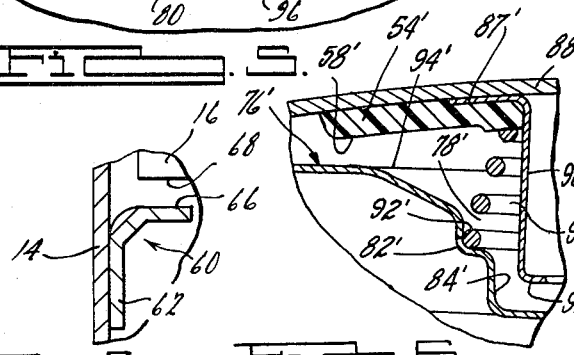
FIG. 6.
FIG. 3.

REFRIGERATION COMPRESSOR SUSPENSION SYSTEM

This is a continuation of application Ser. No. 61,287, now abandoned, filed July 27, 1979 which is a division of application Ser. No. 767,385, filed Feb. 10, 1977, now U.S. Pat. No. 4,174,189 issued Nov. 13, 1979.

BACKGROUND AND SUMMARY OF THE INVENTION

The present invention relates generally to refrigeration compressors of the hermetically sealed type and more specifically to suspension systems for resiliently supporting and restraining such a compressor and its associated motor within a sealed shell.

In hermetic refrigeration compressors, it is generally desirable to resiliently mount the motor-compressor assembly within the shell so as to at least partially insulate the shell from the noise generating vibrations produced by the motor-compressor unit. Such suspension arrangements must be able to absorb the relatively high rotational forces which are generated by the operation cycling of the compressor, and particularly those produced from the strong breaking action exerted by the high pressure discharge head on the compressor as soon as the driving power is shut off. Further, as such compressor assemblies are of considerable weight, the suspension system must be capable of exerting a substantial vertical supporting force. Additionally, because the compressors are hermetically sealed at the time of manufacture, it is not possible to employ removable blocks or like devices to prevent the impacts often encountered during shipping or other handling from damaging portions of the suspension system. Accordingly, permanent shipping stops must be provided as part of the suspension system which are sufficiently strong to absorb the severe shipping impacts which may be encountered, and yet which are also adequately spaced from the static or operating position of the motor-compressor unit to allow the suspension system to absorb the above mentioned operational forces.

A further objective in designing such suspension systems and shipping stops is to insure that they are reliable and are economical to manufacture and assemble, using mass production techniques. Accordingly, it is desirable to minimize the number of parts required so as to insure reliability as well as to minimize manufacturing, inventory and assembly costs.

Numerous arrangements have been developed for suspending and limiting the movement of such motor-compressors of which the following patents are believed to be at least partially representative:

| Pat. No. | Inventor | Issued |
|---|---|---|
| 3,676,339 | Gannaway | April 8, 1975 |
| 3,498,530 | Hoover | March 3, 1970 |
| 3,458,121 | Gleason | July 29, 1969 |
| 3,454,213 | Valbjorn | July 8, 1969 |
| 3,385,542 | Enemark | May 28, 1968 |
| 3,279,683 | Kleinlein | October 18, 1966 |
| 3,185,389 | Loberg | May 25, 1965 |
| 3,182,902 | Foris | May 11, 1965 |
| 3,044,688 | Frank | July 17, 1962 |

Although many of the arrangements disclosed in the above patents may give satisfactory results in the particular applications disclosed, it is believed that none of them fully optimize the various and diverse objectives and considerations set forth above.

Accordingly, it is a primary object of the present invention to provide an improved suspension system for mounting a motor-compressor within a hermetically sealed shell which overcomes many of the disadvantages of known systems, including the provision of such a system which is economical to manufacture and assemble, which readily allows motor-compressors of varying sizes to be mounted within a standard sized shell, which is extremely durable and reliable in use, which effectively restrains the movement of a motor-compressor relative to a shell with a minimum of separate parts, and which is able to effectively absorb the rotational forces exerted by the cyclical operation of the compressor.

Additional objects, advantages and features of the present invention will become apparent from the following description of the preferred embodiments, taken in conjunction with the attached drawings and appended claims.

BRIEF DESCRIPTION OF THE DRAWINGS

FIG. 2 is a partial bottom plan view of the refrigeration compressor of FIG. 1 having the bottom portion of the shell broken away;

FIG. 3 is an enlarged fragmentary sectional view taken along line 3—3 of FIG. 2;

FIG. 4 is an enlarged side elevational view of a suspension spring in accordance with the present invention;

FIG. 5 is a fragmentary view of a portion of the compressor shown in FIG. 1 illustrating a variation thereof; and FIG. 6 is a view of the embodiment of FIG. 5 but incorporating the spacer disc of FIG. 1 therein.

DESCRIPTION OF THE PREFERRED EMBODIMENTS

Figure 1:
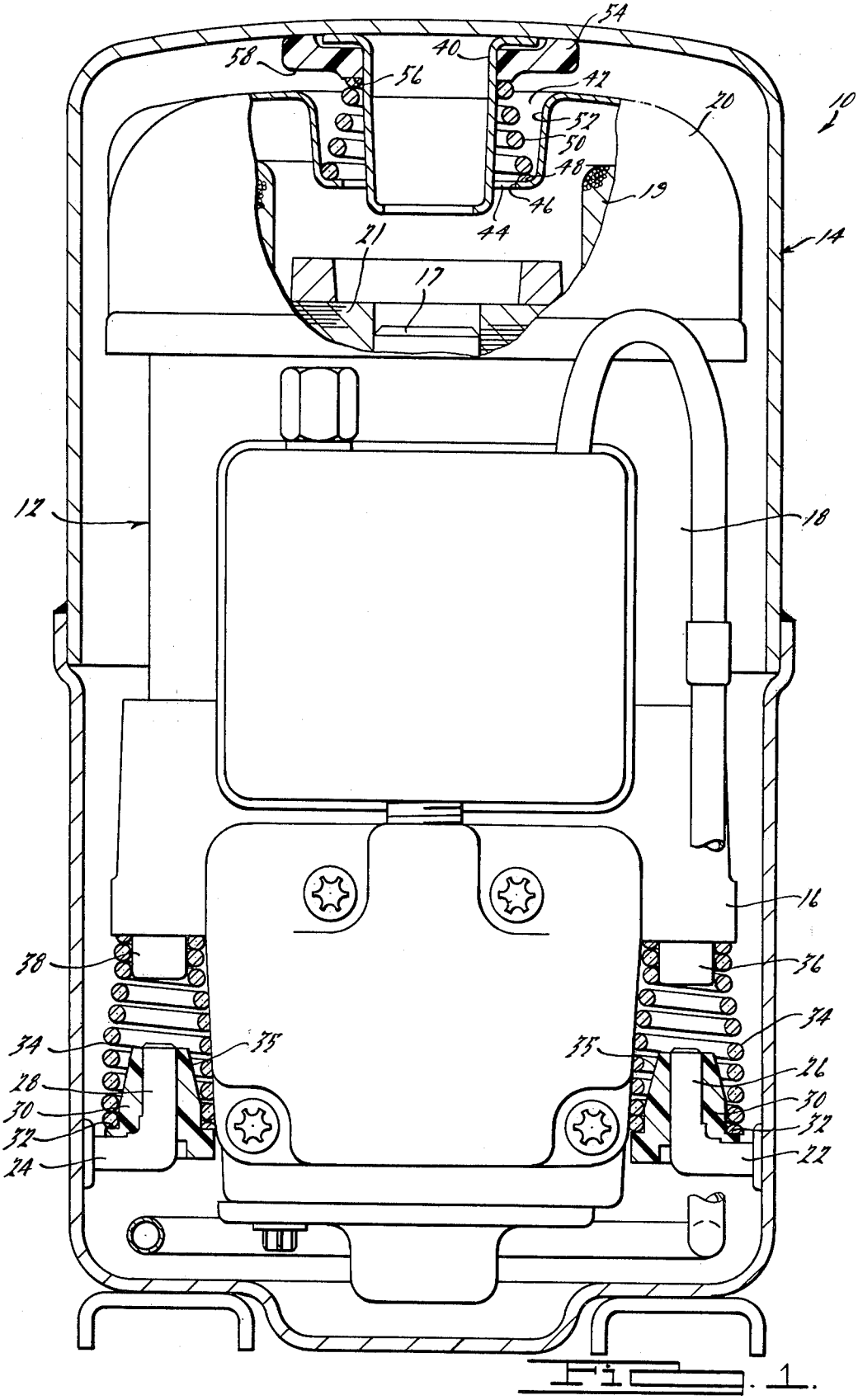
FIG. 1 is a side elevational view of a hermetic refrigeration compressor embodying the present invention, shown partially in section and with parts broken away.

Referring now to FIG. 1, there is shown a refrigeration compressor indicated generally at 10 comprising a motor-compressor assembly 12 resiliently mounted within an outer shell 14 by a three point suspension system in accordance with the present invention. The motor-compressor unit is of the general type disclosed in Gannaway Pat. No. 3,500,907, the disclosure of which is incorporated herein by reference, and includes a lower housing 16 having the compressor means therein, a crankshaft 17, a motor 18, a stator 19 surrounding a rotor 21 secured to crankshaft 17 and a shroud 20 overlying and enclosing an upper end thereof. As can be seen, the upper end of crankshaft 17 terminates slightly below the top of rotor 21. The invention is fully applicable to other motor-compressor designs of the hermetic type.

Two points of the three point suspension system comprise a pair of supporting arms 22 and 24 secured to the opposing lower sidewall portions of shell 14 and include upwardly projecting cylindrically shaped portions 26 and 28, respectively. Upwardly projecting portion 26 of supporting arm 22 has a stabilizer sleeve 30 provided thereon having an upwardly facing annular shoulder portion 32 which supportingly engages an upwardly extending spring 34. Stabilizer sleeve 30 also has conical-shaped upper end portion 35 which aids in assembling spring 34 thereto, as well as insuring that stabilizer sleeve 30 does not interfere with the active open coil portion of spring 34. Upwardly extending arm 28 of supporting arm 24 also has an identical stabilizer sleeve 30 provided thereon having an annular shoulder portion 32 which supportingly engages an identical spring 34 in the same manner as described above.

Housing 16 is provided with a pair of cylindrically shaped downwardly extending projections 36 and 38 positioned thereon so as to be substantially axially aligned with upwardly projecting portions 26 and 28, respectively, of supporting arms 22 and 24. The upper end coils of springs 34 have an inside diameter which is sized with respect to the outside diameter of projections 36 and 38 so as to allow the springs to be forced over and tightly grip projections 36 and 38, thereby forming a rigid connection therebetween, whereby motor-compressor 12 is resiliently supported upon supporting arms 22 and 24.

The third point of this three point suspension system comprises a cylindrically shaped member 40 secured to a top portion of shell 14 and projecting downwardly through both a recess 42 in shroud 20 and into a suction gas inlet opening 44 provided in the bottom portion of recess 42. Cylindrically shaped member 40 cooperates with edge 46 defining opening 44 to act as a shipping stop, limiting lateral movement of motor-compressor 12 in the shell. The space between cylindrical shaped member 40 and edge 46 is sufficiently large to allow suction gas to flow freely into shroud 20 yet small enough to prevent motor-compressor assembly 12 from engaging any portion of shell 14. An annular shoulder 48 is also provided at the bottom of recess 42 and provides a seat for an upwardly extending tapered spring 50. Shoulder portion 48 has a width slightly greater than the diameter of the wire used in fabricating spring 50 so as to insure that when edge 46 engages cylindrical member 40 spring 50 will not be pinched between sidewall portion 52 and cylindrical member 40.

A spacer 54 surrounds cylindrical projection 40 and has a shoulder portion 56 engaging and providing a seat for the upper end of spring 50. A second shoulder portion 58 is also provided on spacer 54 extending radially outward from shoulder 56 beyond the periphery of recess 42 so as to be positioned above a top surface of shroud 20. If desired shoulder 58 can lie in the same plane as shoulder 56. Shoulder portion 58 is adapted to engage the top surface of shroud 20 during upward vertical motion of motor-compressor 12 so as to provide a maximum limit to such motion and is statically spaced therefrom a suitable distance so as to prevent this vertical motion from fully compressing spring 50 or overstressing springs 34, which could result in damage thereto.

Spacer 54 is preferably fabricated from nylon or a similar material and will be of varying thickness depending upon the height of the motor-compressor unit so as to allow the use of a standard height shell to accommodate different height motor-compressor assemblies. Its use is optional, however, in that it can be eliminated in certain assemblies where the shroud may directly contact the shell without damaging the springs. Also, spring 50 is upwardly and inwardly tapered as shown in order to provide a maximum number of coils without increasing the solid or fully compressed height thereof, as well as to reduce or prevent noise being produced by its engagement with cylindrical member 40 or sidewall 52.

In order to limit vertical motion in a downward direction, a pair of vertical shipping stops 60 are secured to shell 14 adjacent supporting arms 22 and 24 by welding, as best shown in FIGS. 2 and 3. Each of the vertical shipping stops 60 comprises a vertically extending leg 62 and a second leg portion 66 disposed at substantially right angles to leg portion 62 and which is adapted to engage a lower portion 68 of housing 16 so as to limit the downward vertical motion of motor-compressor 12. Vertical shipping stop 60 is positioned on shell 14 so as to prevent excess downward vertical movement of motor-compressor 12 which might otherwise fully compress and possibly damage springs 34 and/or prevent cylindrical member 40 to come out of opening 44.

An enlarged view of a suspension spring 34 is shown in FIG. 4. As seen therein, this spring is formed with a plurality of closed coils 69 at the lower end thereof. These coils are formed with an inside diameter which will allow spring 34 to slip easily over and resiliently engage stabilizer sleeve 30, thereby minimizing the transmission of forces generated during cycling of the compressor to supporting arms 22 and 24. A plurality of relatively large diameter open coils 70 extend upward from closed coils 69. The relatively large diameter coils 70 allow spring 34 to be fabricated with a relatively large diameter wire thereby maximizing spring strength while also providing a maximum lateral flexibility thereto. This lateral flexibility is important in that substantially all of the unbalanced operational forces exerted on these springs by the compressor will be laterally directed. A second plurality of closed coils 72 is provided at the upper end of spring 34 having an inside diameter, as previously mentioned, so as to provide a rigid connection with cylindrical projections 36 and 38 which serves to restrain the compressor during stop and start reactions as well as to facilitate mounting of the motor-compressor unit within the shell 14 during assembly. A plurality of decreasing diameter coils 74 extend from open coils 70 to closed end coils 72. Tapered coils 74 relieve the stress due to the relatively rigid connection between springs 34 and cylindrical projections 36 and 38.

Preferably, only one or two closed coils 69 are provided, so as to maximize the number of actual open coils which are available for a given spring length. Also, preferably, only two or three closed coils 72 will be provided, i.e. a sufficient number to maximize the gripping action on the cylindrical projections 36 and 38. Open coils at this location would not improve lateral flexibility. Both ends of each spring 34 may be ground flat, as best shown in FIG. 4. It has ben found that in springs employed to support motor-compressors weighing approximately 50–60 pounds and having approximately ½ inch inside diameter closed coil rigid connections, 1½ to 2 tapered coils 74 will provide sufficient stress relief. The desired number of open coils 70 will be dependent upon the wire diameter, desired lateral flexibility and maximum compressed height required. For example, the smaller the wire diameter, the greater number of coils required, all other variables being constant, and the greater the wire diameter, the lesser number of coils possible, all other variables being constant.

An alternative lateral motion limiting shipping stop for compressors not having a suction inlet in the top center of the shroud is illustrated in FIG. 5, and comprises a shroud 76 similar to shroud 20 enclosing one end of a motor and having a recess 78 centrally disposed therein. Recess 78 includes a closed bottom portion 80, an annular radially inwardly projecting shoulder portion 82 lying in a plane perpendicular to the longitudinal axis of the motor, and a cylindrical shoulder portion 84 extending between bottom 80 and the radially inner edge of shoulder 82. A cylindrical member 86 is secured to shell 88 by annular flange portion 87 and projects into recess 78 below annular shoulder 82. A tapered spring 90, substantially identical to spring 50 described above, has a lower end seated on a shoulder 82 and an upper end engaging annular flange portion 87 of cylindrical member 86. Shoulder portion 82 is of a width slightly greater than the diameter of the wire used to fabricate spring 90 so as to insure that when lateral forces exerted on the motor-compressor cause cylindrical shoulder portion 84 to engage cylindrical member 86, a sufficient space will remain between sidewall portion 92 of recess 78 and cylindrical member 86 to accommodate spring 84, thereby preventing spring 84 from being pinched and damaged.

It should also be noted that annular shoulder 82 is positioned a sufficient distance within recess 78 so as to allow top surface 94 of shroud 76 to contact shell 88 without fully compressing spring 90. Further, bottom 80 of recess 78 and lower end 96 of cylindrical member 86 are spaced a sufficient distance to prevent mutual engagement when top surface 94 of shroud 78 engages shell 88. It should also be noted that spacer 54 may be provided between spring 90 and shell 88 in like manner and operation as described with reference to FIG. 1 if desired.

It is thus apparent that the present invention provides an extremely reliable, durable and low cost three point suspension system for mounting a refrigeration compressor within a shell which requires a minimum number of components and yet effectively supports the compressor and restrains horizontal, vertical and rotational movement thereof. Further, the present invention enables a single sized shell to be employed in combination with numerous compressors having differing overall heights.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. A suspension system for a hermetic compressor comprising:

a hermetically sealed shell;

compressor means including a driving motor disposed within said shell;

a shroud enclosing one end of said motor;

a pair of spaced vertically extending supporting arms secured to sidewall portions of said shell;

a spring extending between each of said supporting arms and said compressor means to resiliently support said compressor within said shell, each of said springs having a plurality of helical coils, said coils being of upwardly decreasing diameter so as to define a single upwardly converging tapered portion; and stop means secured to said shell, said stop means being directly engageable with said shroud and cooperating with said springs to limit relative movement of said compressor means with respect to said shell.

2. A suspension system as set forth in claim 1 wherein each of said springs has a first plurality of closed coils of a first diameter at one end, a second plurality of closed coils of a second diameter at the opposite end, a plurality of open coils of said second diameter adjacent said opposite end, said tapered portion comprising a plurality of decreasing diameter coils extending from said plurality of open coils to said first plurality of closed coils.

3. A suspension system as set forth in claim 1 wherein said compressor means includes a housing having a pair of spaced downwardly extending cylindrical projections, a plurality of coils at one end of each of said springs surrounding each of said projections to thereby form a rigid connection therebetween.

4. A suspension system as set forth in claim 3 wherein said plurality of coils are closed coils and are sufficient in number to be coextensive with the length of said projection.

5. A suspension system as set forth in claim 3 wherein said tapered portion is immediately adjacent said plurality of coils to thereby relieve the stress due to said rigid connection.

6. A suspension system for a hermetic refrigeration compressor comprising:

a hermetically sealed shell;

compressor means including motor means drivingly connected thereto;

a shroud covering one end of said motor, and having means defining a recess therein;

a pair of spaced vertically extending supporting arms secured to a sidewall portion of said shell;

a spring extending between each of said supporting arms and said compressor means to resiliently support said compressor within said shell, each of said springs having a plurality of helical coils, said coils being of upwardly decreasing diameter so as to define a single upwardly converging tapered portion;

stop means secured to said shell and extending into said recess, said stop means being directly engageable with said means defining said recess and cooperating with said springs to limit relative movement of said compressor means with respect to said shell; and a plurality of vertical stop means secured to said shell and cooperating with said compressor means to prevent said recess from moving out of cooperative relationship with said stop means.

7. A suspension system for a hermetic compressor comprising:

a hermetically sealed shell;

compressor means including a driving motor disposed within said shell;

a plurality of springs extending between said compressor means and support means provided on said shell for resiliently supporting said compressor means within said shell, each of said springs having a first closed coil of a first diameter at one end thereof supportingly engaging said support means;

a plurality of open coils of said first diameter connected to said first closed coil;

a second closed coil of a second diameter less than said first diameter at the other end thereof attached to said compressor means; and a plurality of decreasing diameter open coils extending between and interconnecting said open coils and said second closed coil.

8. A suspension system as set forth in claim 7 wherein each of said springs has constant pitch open coils.

9. A suspension system as set forth in claim 7 wherein said second plurality of closed coils are rigidly connected to said compressor means and said tapered portion relieves spring stress due to said rigid connection.

* * * * *

UNITED STATES PATENT AND TRADEMARK OFFICE

CERTIFICATE OF CORRECTION

PATENT NO. : 4,427,349

DATED : January 24, 1984

INVENTOR(S) : John P. Elson

It is certified that error appears in the above-identified patent and that said Letters Patent are hereby corrected as shown below:

Column 1, line 57, "3,676,339" should be -- 3,876,339 --.

Column 2, line 49, "3,500,907" should be -- 3,509,907 --.

Column 4, line 51, "ben" should be -- been --.

Signed and Sealed this

*Seventeenth* Day of *April 1984*

[SEAL]

*Attest:*

GERALD J. MOSSINGHOFF

*Attesting Officer*

*Commissioner of Patents and Trademarks*